United States Patent [19]

Romero Hernandez

[11] Patent Number: 4,922,627

[45] Date of Patent: May 8, 1990

[54] PRESS DRYING CONCEPT

[75] Inventor: Jose Romero Hernandez, Cowansville, Canada

[73] Assignee: Albany International Corp., Albany, N.Y.

[21] Appl. No.: 414,760

[22] Filed: Sep. 29, 1989

[51] Int. Cl.[5] ..... D06F 58/00; F26B 3/00

[52] U.S. Cl. ..... 34/116; 34/117; 34/23; 34/113; 34/123; 162/206

[58] Field of Search ..... 34/116, 111, 113, 123, 34/23; 162/206, 358, 359, 360.1

[56] References Cited

U.S. PATENT DOCUMENTS

| | | | |
|---|---|---|---|
| 1,660,640 | 2/1928 | Asten | 34/111 |
| 3,283,415 | 11/1966 | Schnyder | 34/111 |
| 3,293,767 | 12/1966 | Means | 34/116 |
| 4,483,745 | 11/1984 | Wicks et al. | 162/360.1 |
| 4,718,982 | 1/1988 | Swenson et al. | 162/206 |
| 4,823,688 | 4/1989 | Wedel et al. | 162/206 |

*Primary Examiner*—Henry A. Bennet
*Assistant Examiner*—Denise L. Ferensic
*Attorney, Agent, or Firm*—Kane, Dalsimer, Sullivan, Kurucz, Levy, Eisele & Richards

[57] ABSTRACT

The invention consists of modified dryer section in a papermachine wherein elements normally found in the press section of the machine are included in the dryer section. The modification consists of the use of a press felt instead of a dryer felt and the addition of press rolls, adjacent to the dryer cylinders, forming nips through which the felt and the wet paper sheet to be dried are passed. Pocket ventilation rolls are also included to evaporate water absorbed by the felt from the paper sheet during passages through the nips. The dryer section incorporating these modifications can be viewed as a press-dryer hybrid. Improved dryer efficiency and lower costs per ton of paper produced are the results.

5 Claims, 3 Drawing Sheets

PRESS DRYING CONCEPT

BACKGROUND OF THE INVENTION

1. Field of the Invention

This invention constitutes an improvement to the dryer section of a modern papermaking machine. The improvement involves the incorporation into the dryer section of components normally found only in the press section More specifically, the dryer section, modified according to this invention, would include press rolls adjacent to the dryer cylinders; wet press felts rather than the usual dryer felts; and pocket ventilation rolls to dry the wet press felts after absorbing water from the paper sheet.

2. Description of the Prior Art

Modern papermaking machines are typically composed of these sections: the forming, press and dryer sections. All three sections share the common goal of removing water from the material which eventually emerges from the end of the machine as paper. The process begins in the forming section, where the furnish, an aqueous suspension of wood fiber, is deposited on the forming wire, a moving, screen-like continuous belt. Also known as a forming fabric, the wire, formerly woven from metal strands, is now most commonly woven from polyester monofilament in a pattern that ensures both a smooth forming surface and a sufficient permeability to allow much of the water to drain through and out of the furnish.

At the end of the forming section, the wet fibrous sheet is still largely water, yet is now substantial enough to be picked up by a press felt and carried through the press section.

The press felt itself is also a continuous fabric belt, although much different from a forming wire. Today, it is literally inaccurate to refer to these fabrics as "felt". Years ago, however, they were produced from wool and, after weaving, felted by traditional methods to produce a fabric having a smooth surface. Wool has fallen largely out of use, except for the production of certain very fine, specialized papers. Yet, just as the forming fabric is referred to as a "wire" even though it contains no metal, the term "felt" is still used widely, if not universally, to refer to the fabrics used in the press and dryer sections.

The press felt has the two-fold purpose of carrying the wet fibrous sheet through the press section and of absorbing water that is squeezed from the sheet. The squeezing action takes place in the presses, where the felt and sheet are compressed together such as, for example, by passing together through the narrow gap, or nip, between two closely adjacent press rolls. There, the felt absorbs water squeezed from the sheet by the compression and prevents rewet. Quite commonly, the wet fibrous sheet is carried through the press section between two press felts in a sandwich-like fashion both to prevent damage to the sheet by the press rolls and to enhance the degree of water removal.

At the end of the press section, the wet sheet continues on to the dryer section where the remaining water is removed by conducting it around each in a series of steam-heated cylinders. The fabrics, or dryer felts, serve to hold the wet sheet firmly against the cylinder, in order to maximize the degree of heat transfer and more efficiently evaporate the remaining water. At the end of the dryer section, the sheet, now paper, emerges as the final product.

One of the important concerns in any papermaking operation is to produce a quality paper at maximum efficiency. Costs associated with the dryer section, such as those required to produce steam for the dryer cylinders, can cut deeply into potential profits, especially in this era of rising energy costs. Much of the search for improved press designs and better press felts is driven by the need to make the amount of water to be removed from the sheet in the dryer section as small as possible. In this way, it is hoped, costs for fuel consumed in steam production will be reduced.

The present invention represents a different line of attack toward a solution of this basic problem. It involves incorporating certain elements, normally found only in a press section, into a dryer section as a way to achieve a more fuel-efficient operation.

SUMMARY OF THE INVENTION

The purpose of this invention is to enhance the efficiency of the dryer section in a modern papermachine. This is accomplished by including certain elements, normally found only in the press section, into one or more stages of the dryer section. In this way, the dryer section becomes, in a sense, a press-dryer hybrid section.

It is well known that the dryer section can be composed of one or more separate stages. Each stage comprises an upper and lower series of steam-heated cylinders, an upper and lower dryer felt, and the usual guide and tension rolls to direct and control the motion of the felts. It is the function of the dryer felts to hold the wet sheet firmly against the surface of the steam-heated cylinders in order to maximize the heat transfer to the sheet and the drying efficiency. In passing through each stage of the dryer section, the wet sheet follows a rather zig-zag path, alternately wrapping around successive upper and lower dryer cylinders. The paper sheet makes contact with better than half of the surface of each cylinder as it wraps around and alternates between those in the upper and lower series.

This invention is practiced by modifying the dryer section in the following manner. Press rolls are first added to the dryer cylinders in a given series in the dryer section. In this way, nips are formed at the point of contact between the dryer cylinder and press roll. The felt and wet paper sheet are passed through each such nip during the normal operation of the papermachine.

The dryer felts usually installed on dryer sections are not suitable for use with the present invention. Typically, these fabrics are light, airy, highly permeable, and smooth surfaced. However, here, with the incorporation of certain elements from the press section, one requires a felt designed for use on that section because, as some degree of compression will occur in the nips adjacent to each dryer cylinder, the felt will have to be bulky enough to absorb water. Further, a typical dryer felt, if used on a dryer section modified in accordance with the present invention, would tend to mark the paper sheet being dried when compressed against it in a nip. It is recommended that a wet felt weighing from 1000 to 1200 grams per square meter and having a permeability of from 60 to 120 cubic feet per minute be used instead of the usual dryer felt.

In each nip, the press roll will squeeze water from the wet paper sheet into the felt. The pressure applied by each press roll is not as high as that in the press section, but, as there will be more press rolls than in the press section, the overall result will be the same.

In addition to squeezing the wet paper sheet against the dryer cylinders, the press rolls increase the level of contact of the sheet against the cylinders. This will improve the surface finish imparted to the paper sheet and make the moisture content profile across the sheet more uniform.

After each passage through a nip, the paper sheet will continue on to pass around the next dryer cylinder. The dryer felt, having acquired some quantity of water from the sheet, will then be passed around a pocket ventilation roll, which will warm it and evaporate any water. The felt then proceeds to the next dryer cylinder and nip in the series. Pocket ventilation will also maintain a proper differential between the wet and dry bulb readings in the pockets to improve overall drying efficiency. In other words, humidity will be kept at a sufficiently low level to assure that evaporation of the water from the paper sheet will proceed efficiently.

It should be understood that this principle can be applied in one or all of the dryer cylinders, in one stage of the dryer section, in the upper or lower series of a given stage, or in the entire dryer section. The ultimate choice will depend upon the final efficiency desired and the needs of the given paper manufacturing operation.

In general, the application of the press and dry principle will reduce the cost of paper per ton and increase the efficiency of the machine by producing a drier sheet, by permitting machine speeds to be increased, and by improving sheet dryness cross-machine profile.

DESCRIPTION OF THE PREFERRED EMBODIMENT

Figure 1:
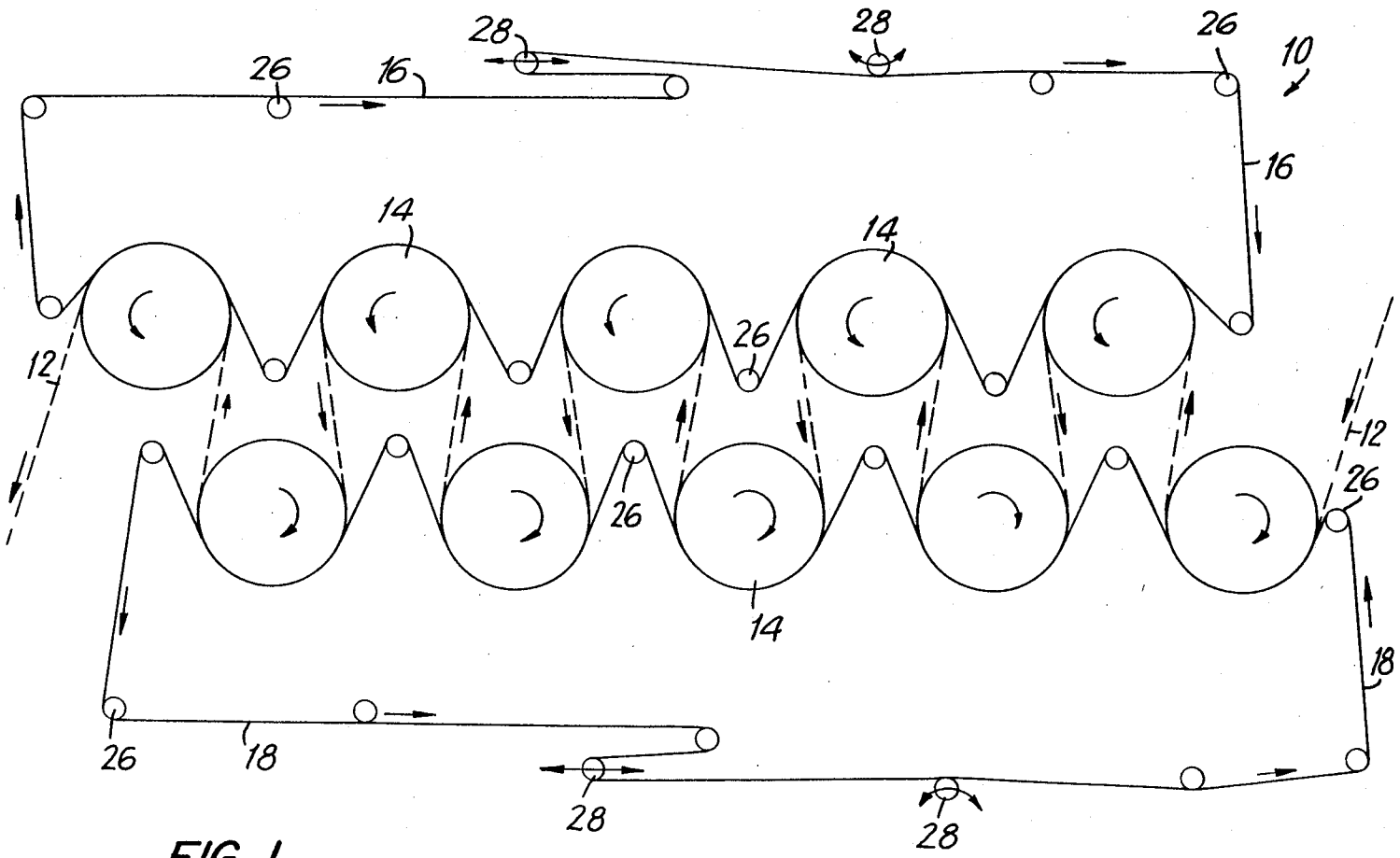
FIG. 1 PRIOR ART
FIG. 1 shows a stage of a conventional dryer section of a papermaking machine.

In FIG. 1 is depicted a stage 10 of a conventional dryer section of a papermaking machine. The wet paper sheet 12, represented in the figure by the dashed line, enters on the right and, proceeding as indicated by the arrows, passes in sequence around each in an upper and lower series of steam-heated dryer cylinders 14, and emerges on the left as either a fully dried sheet of paper or a still partially wet sheet bound for a further stage in the dryer section, similar to that shown in the figure. It should be understood that a dryer section can include two, three, or more stages like that shown in FIG. 1.

The stage 10 in the dryer section comprises an upper dryer felt 16 and a lower dryer felt 18, each of which holds the wet paper sheet 12 against the dryer cylinders 14 to increase the intimacy of their contact and to thereby maximize the heat transferred. Conventional dryer felts, such as the upper dryer felt 16 and the lower dryer felt 1B in FIG. 1, have little capacity for absorbing liquid water. Rather, these fabrics generally have open weaves so that water in its vapor phase evaporated from the wet paper sheet 12 can pass freely through. Typically also, dryer fabrics have smooth surfaces to more firmly hold the wet paper sheet 12 against the dryer cylinders 14 and to minimize marking. Also shown in FIG. 1 are guide rolls 26 and tension rolls 28, which direct and control the motions of the upper dryer felt 16 and the lower dryer felt 18, which proceed as indicated by the arrows. The dryer cylinders 14 rotate in the senses indicated.

Figure 2:
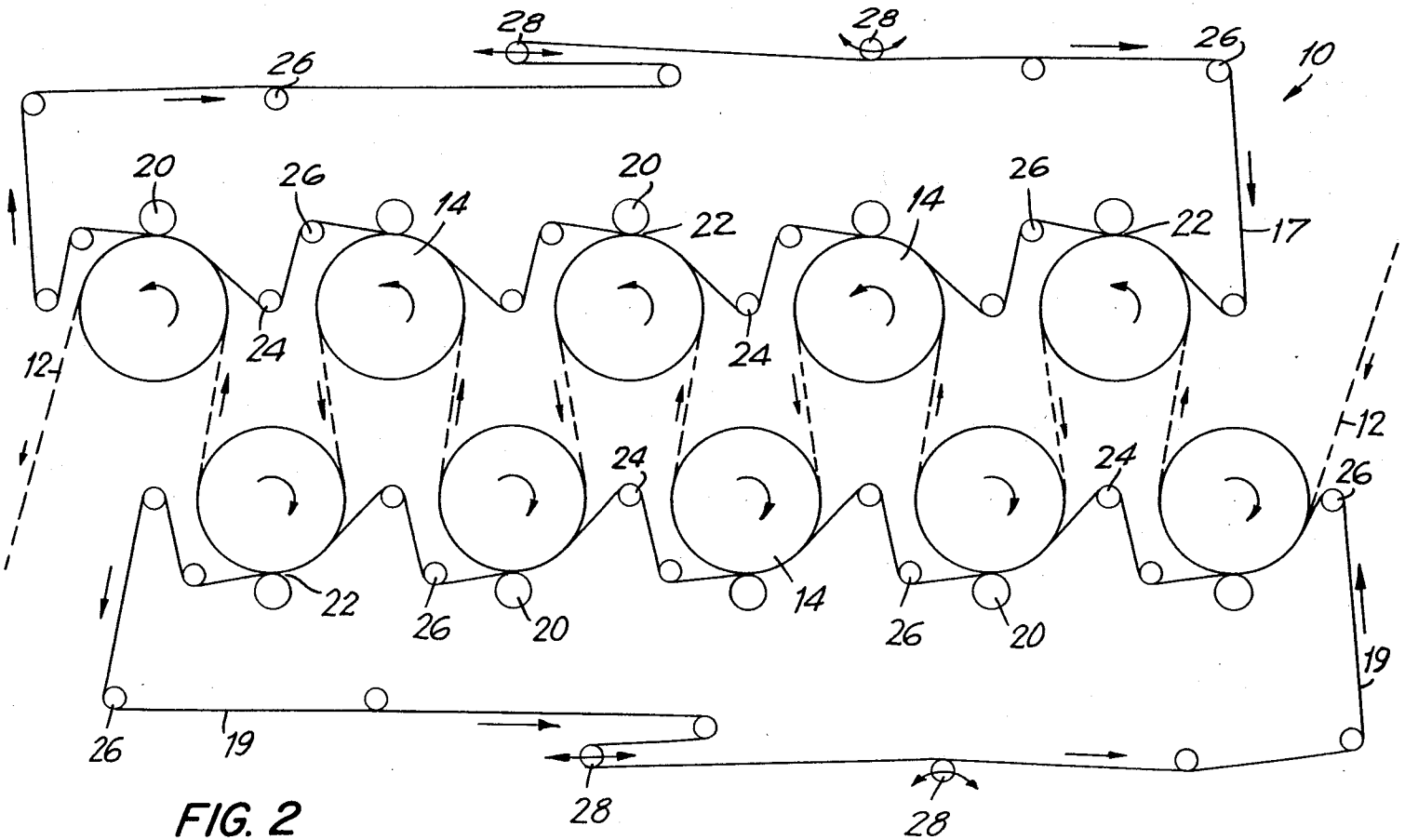
FIG. 2 shows a stage of a dryer section which has been modified in accordance with the present invention.

In FIG. 2 is shown a stage 10 of a dryer section which has been modified in accordance with the present invention. In FIG. 2, as well as in FIG. 3 to follow, common elements already shown in FIG. are given the same identifying numerals. Therefore, the wet paper sheet 12, again represented by the dashed line, enters the stage 10 of the dryer section on the right and, proceeding as indicated by the arrows, passes in sequence around each in an upper and lower series of steam-heated dryer cylinders 14, and emerges on the left.

In FIG. 2, however, the dryer section 10 comprises an upper press-dryer felt 17, and a lower press-dryer felt 19, both of which, despite their identification as press-dryer felts, are physically the same as press fabrics. This is because typical dryer felts do not have the ability to absorb water in its liquid form as required by the present invention, and would mark the wet paper sheet 12 if pressed against it in a press nip. The upper press-dryer felt 17 and lower press-dryer felt 19 hold the wet paper sheet 12 against the dryer cylinders 14.

Adjacent to each dryer cylinder 14 in FIG. 2 is a press roll 20 forming a nip 22 through which pass the wet paper sheet 12 and either the upper press-dryer felt 17 or the lower press-dryer felt 19.

It will be noted that, as it wraps around each in the series of dryer cylinders 14, the wet paper sheet 12 is in contact with at least half of the surface of each dryer cylinder 14. In a typical dryer section stage 10, such as that shown in FIG. 1, the upper dryer felt 16 or the lower dryer felt 18 would hold the wet paper sheet 12 against the surface of each dryer cylinder 14 for almost this entire amount.

The dryer-section modifications of the present invention change this relationship considerably. This results from the inclusion of a pocket ventilation roll 24 for each dryer cylinder 14.

As the wet paper sheet 12 proceeds around each dryer cylinder 14, it is first pressed to the surface thereof by he upper press-dryer felt 17 or the lower press-dryer felt 19. In this manner, the wet paper sheet 12 is first warmed by each dryer cylinder 14, whose surface temperature is typically between 60 and 100 degrees Celsius.

It is well-known that as water is warmed, it becomes less viscous. Physically, this means that it will flow more readily. As a consequence, warm water will drain more easily through the fibers in the wet paper sheet 12 for removal by absorption into either the upper press-dryer felt 17 or the lower press-dryer felt 19.

The wet paper sheet 12, now warmed, and either the upper press-dryer felt 17 or the lower press-dryer felt 19, then pass together through a nip 22 formed by the dryer cylinder 14 and the press roll 20. In the nip 22, compression squeezes water from the wet paper sheet 12 which will be absorbed by either the upper press-dryer felt 17 or the lower press-dryer felt 19.

To avoid rewetting the paper sheet 12 upon exit from the nip 22, the upper press-dryer felt 17 or the lower press-dryer felt 19 is immediately separated therefrom. While the paper sheet 12 remains in contact for a time with the surface of the dryer cylinder 14 before proceeding across the pocket to the next one in the series, the upper press-dryer felt 17 or the lower press-dryer felt 19 passes over a guide roll 26 and proceeds to a pocket ventilation roll 24, which warms the water absorbed from the wet paper sheet 12 and evaporates it from the felt before its entry into the next nip 22. In this manner, the upper press-dryer felt 17 or the lower press-dryer felt 19 is dried and prepared for passage through the next nip 22 in the series or for return to the first dryer cylinder 14 in this stage 10 of the dryer section by means of further guide rolls 26 and tension rolls 28.

As noted earlier, the dryer section of a modern papermaking machine may include two, three, or more, stages like that shown in FIG. 1. These would be arranged sequentially, so that a paper sheet 12 exiting on the left side of FIG. 1 will proceed onward to a further stage, entering as shown on the right side of FIG. 1.

One could adapt a dryer section in accordance with the present invention by modifying any portion up to and including the entire section. It would be quite possible, therefore, to modify the initial stages of the dryer section, but to leave the later stages in the conventional configuration shown in FIG. 1. Of course, the extent to which a dryer section on any given papermaking machine should be modified is best determined by the needs of that paper manufacturer.

Figure 3:
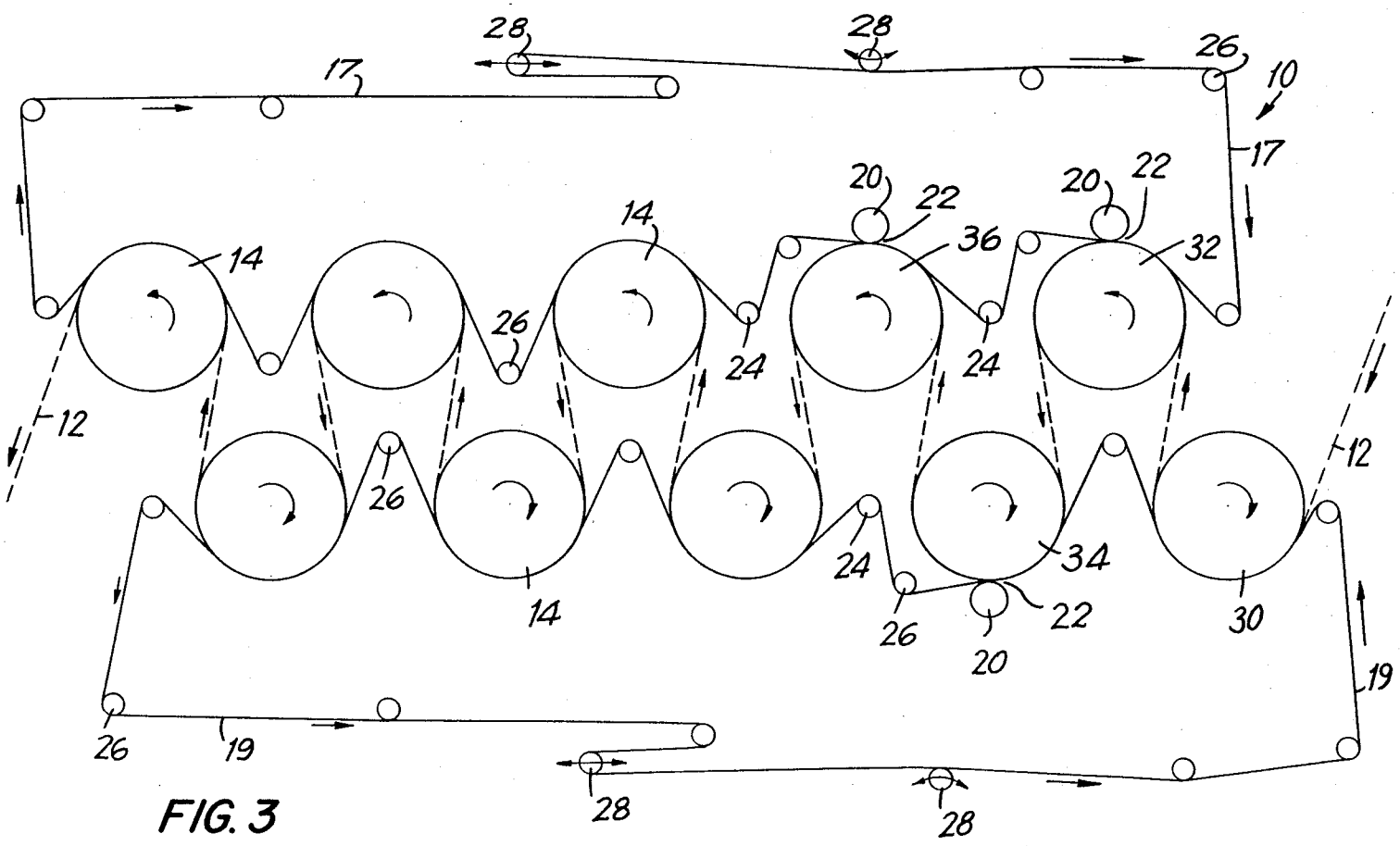
FIG. 3 shows an alternate embodiment of a stage of a dryer section so modified.

One possible approach is shown in FIG. 3, which represents the first stage 10 of a multi-stage dryer section. The wet paper sheet 12 enters the dryer section on a right side of FIG. 3 from the press section, not shown.

This first stage 10 includes an upper press-dryer felt 17 and a lower press-dryer felt 19. It will be noted, however, that in contrast with the complete modification shown in FIG. 2, only three dryer cylinders 14 have been modified by the addition of press rolls 20 and pocket ventilation rolls 24. Nevertheless, even when only some of the dryer cylinders 14 have been modified, the upper press-dryer felt 17 and the lower press-dryer felt 19 must be press-like fabrics to absorb water and to prevent sheet marking in the nip 22. Proceeding in sequence through this first stage as would a given increment of the wet paper sheet 12, the first dryer cylinder 30 has not been modified and provides what can be considered a warm-up stage.

The second, third, and fourth dryer cylinders 32,34,36 have been so modified by the addition of press rolls 20, forming nips 22, and pocket ventilation rolls 24, all of which function as previously described. The remaining dryer cylinders 14 have not been modified and appear as those shown in FIG. 1. The usual guide rolls 26 and tension rolls 28 are also shown. The wet paper sheet 12 exiting on the left can proceed to a conventional stage 10 in a dryer section, as shown in FIG. for additional drying.

Quite clearly, numerous modifications to the above could be devised by anyone skilled in the art, yet still remain within the scope of the appended claims.

What is claimed is:

1. An improved dryer section for a papermaking machine, said dryer section having at least one stage, each said stage having an upper series and a lower series of heated dryer cylinders, each of said upper series and lower series having a plurality of said dryer cylinders, so that a wet paper sheet may be dried by being passed sequentially and alternately around said dryer cylinders of each of said upper series and lower series, said wet paper sheet being held against said dryer cylinders of said upper series and said lower series by an upper dryer felt and a lower dryer felt respectively, wherein the improvement comprises:

a press felt used in place of one of said upper and lower dryer felts;

a press roll adjacent to a dryer cylinder in one of said upper and lower series, said series being that on which said press felt is used, said press roll forming a nip through which said wet paper sheet and said press felt pass together in a compressed state;

means for holding said wet paper sheet against said dryer cylinder before passage of said wet paper sheet and said press felt through said nip, so that said wet paper sheet will be warmed by said dryer cylinder;

means for separating said press felt from said wet paper sheet after passage through said nip to prevent the rewetting of said wet paper sheet; and to remove water absorbed by said press felt and to dry said press felt after passage through said nip.

2. An improved dryer section for a papermaking machine as claimed in claim 1 wherein said means for holding said wet paper sheet against said dryer cylinder is another said dryer cylinder.

3. An improved dryer section for a papermaking machine as claimed in claim 1 wherein said means for separating said wet paper sheet is a guide roll around which said press felt is disposed.

4. An improved dryer section for a papermaking machine as claimed in claim 1 wherein said means to remove water absorbed by said press felt and to dry said press felt is a pocket ventilation roll.

5. In a method for drying a wet paper sheet in the dryer section of a papermaking machine, said dryer section having at least one heated dryer cylinder around which said wet paper sheet to be dried is passed, the improvement comprising:

holding said wet paper sheet against said dryer cylinder with a press felt;

providing a press roll adjacent to said dryer cylinder to form a nip through which said wet paper sheet and said press felt pass together in a compressed state;

holding said wet paper sheet against said dryer cylinder before passage through said nip;

separating said press felt from said wet paper sheet after passage through said nip; and removing absorbed water from said press felt by evaporation.

* * * * *